United States Patent [19]

Kumar et al.

[11] 4,392,217

[45] Jul. 5, 1983

[54] DEVICE FOR CONTROLLING CORRECTION OPERATIONS OF A TIME DISPLAY DEVICE

[75] Inventors: Niraj Kumar, Indialantic, Fla.; Marc Mouthon, Cornaux, Switzerland

[73] Assignee: Ebauches Electroniques, S.A., Switzerland

[21] Appl. No.: 234,459

[22] Filed: Feb. 17, 1981

[30] Foreign Application Priority Data

Feb. 18, 1980 [CH] Switzerland ..... 1291/80

[51] Int. Cl.[3] ..... G04C 9/00

[52] U.S. Cl. ..... 368/188

[58] Field of Search ..... 368/187, 188, 185, 200, 368/201, 202

[56] References Cited

U.S. PATENT DOCUMENTS

| | | | |
|---|---|---|---|
| 4,030,283 | 6/1977 | Sauthier et al. | 368/188 |
| 4,173,863 | 11/1979 | Motoki et al. | 368/185 |
| 4,185,453 | 1/1980 | Jaunin | 368/187 |
| 4,232,384 | 11/1980 | Jaunin | 368/188 |
| 4,245,338 | 1/1981 | Sekiya et al. | 368/187 |
| 4,261,048 | 4/1981 | Motoki et al. | 368/187 |
| 4,275,463 | 6/1980 | Ishida | 368/188 |
| 4,308,607 | 12/1981 | Sekiya et al. | 368/188 |

*Primary Examiner*—J. V. Truhe
*Assistant Examiner*—Forester W. Isen
*Attorney, Agent, or Firm*—Allegretti, Newitt, Witcoff & McAndrews, Ltd.

[57] ABSTRACT

A device comprises means for distinguishing a short depression from a long depression depending on the period of actuation of a control button (block 14), means for selecting in the case of a short depression a minutes correction mode in which the display advances by one minute for each pressure (block 18) and, in the case of a long depression, an hours correction mode in which the display advances by complete hours as long as the depression lasts (block 19). It further comprises means for defining two different advance speeds, a slower speed (SLOW+60 m) and a faster speed (FAST+60 mn) in the hours correction mode, and means for passing automatically first to the slow speed to advance a first hour and then to the fast speed for the following hours.

3 Claims, 3 Drawing Figures

SW 22
1-2m
Cl
Q̄
27
STOP
28
MN
1Hz
25
26
H
21
R
R
1-2s
Q
61
35
1Hz
24
36
Ā
E
32
M
31
DELAY
C
34
40
33
23
15-30s
Q̄
FLIP FLOP
B
39
38
R
S
15s
30
29
37

8Hz
54
53
H
41

E
45
46
43
44
8Hz
49
Div/5
Div/12
1kHz
42
48
51
R
55
56
Q̄
57
Ā
52
H
1Hz

DEVICE FOR CONTROLLING CORRECTION OPERATIONS OF A TIME DISPLAY DEVICE

BACKGROUND OF THE INVENTION

The present invention concerns controlling correction operations of a time display device, particularly but not exclusively a watch. It is particularly useful in devices giving an analog display by means of hands rotating over a time face or dial, as it is in such a case that it yields most advantages, but it may also be usefully applied in devices with a digital display of hours, minutes and possibly seconds. Indeed, the invention essentially seeks to provide for rapid correction operations by means of a simple procedure which limits the possibility of errors on the part of the operator and wrong handling, this being achieved in that the different correction sequences are produced automatically, with the required speed, from operation of a single control button.

Although many devices for controlling correction operations of a time display are already known, such devices have never fully succeeded in sufficiently reconciling the requirements in respect of speed, and simplicity and reliability of operation. In a digital display device, it is conventional to separately correct the minutes figures and hours figures, but transferring from the minutes correction mode to the hours correction mode generally requires action on the part of the operator of the device. In other cases, there are two speeds of advance of the figures which display the time overall (hours and minutes), these being selected by the user of the device by means of two different control buttons. For analog display watches, it has also been proposed that the same control button may be used for correcting the minutes display by means of short control pulses, and the hours display by continuous actuation of the control button. However, these arrangements are still far from achieving the speed of correction which is to be desired.

BRIEF SUMMARY OF THE INVENTION

The object of the present invention is to make it possible to go from a minute correction mode to an hours correction mode in accordance with the period of actuation of one and the same control button, and, without involving any other manual control, and also to make it possible to ensure speed of operation in the hours correction mode, without in any way losing in accurancy in the minutes correction mode.

According to the present invention, there is provided a device for controlling correction operations of a time display device showing hours and minutes, comprising a control button and means for distinguishing a short depression from a long depression, depending on the period of actuation of the control button, means for selecting in the case of a short depression a minutes correction mode in which the display advances by one minute for each depression and, in the case of a long depression, an hours correction mode in which the display advances by complete hours as long as the depression lasts, and means for defining two different advance speeds, a slower speed and a faster speed, in the hours correction mode, and means for passing automatically firstly to the slow speed to advance a first hour and then to the fast speed for the following hours.

In the case of a display device which indicates not only hours and minutes but also seconds, the device may further comprise means for distinguishing a first short depression from following short or long depressions, and means for automatically returning the seconds display to 0 upon the first short depression.

In a preferred embodiment of the invention, the display is of the analog type and correction always involves rotation of the two hands, the minute hand and the hour hand, the minute hand performing complete turns around the dial in the hours correction mode. It is then advantageous to provide for the minute hand to advance in jumps, at least in the fast-speed correction mode, for example by means of trains of correction pulses, which facilitates reading the display in the course of correction in order to decide on the moment at which, when the desired hour is to be reached at the end of the rotary movement of the hand, the pressure on the control button should be stopped.

BRIEF DESCRIPTION OF THE DRAWINGS

The invention will be described in more detail, by way of example, with reference to the accompanying drawings in which.

DETAILED DESCRIPTION OF THE PREFERRED EMBODIMENT

Figure 1:
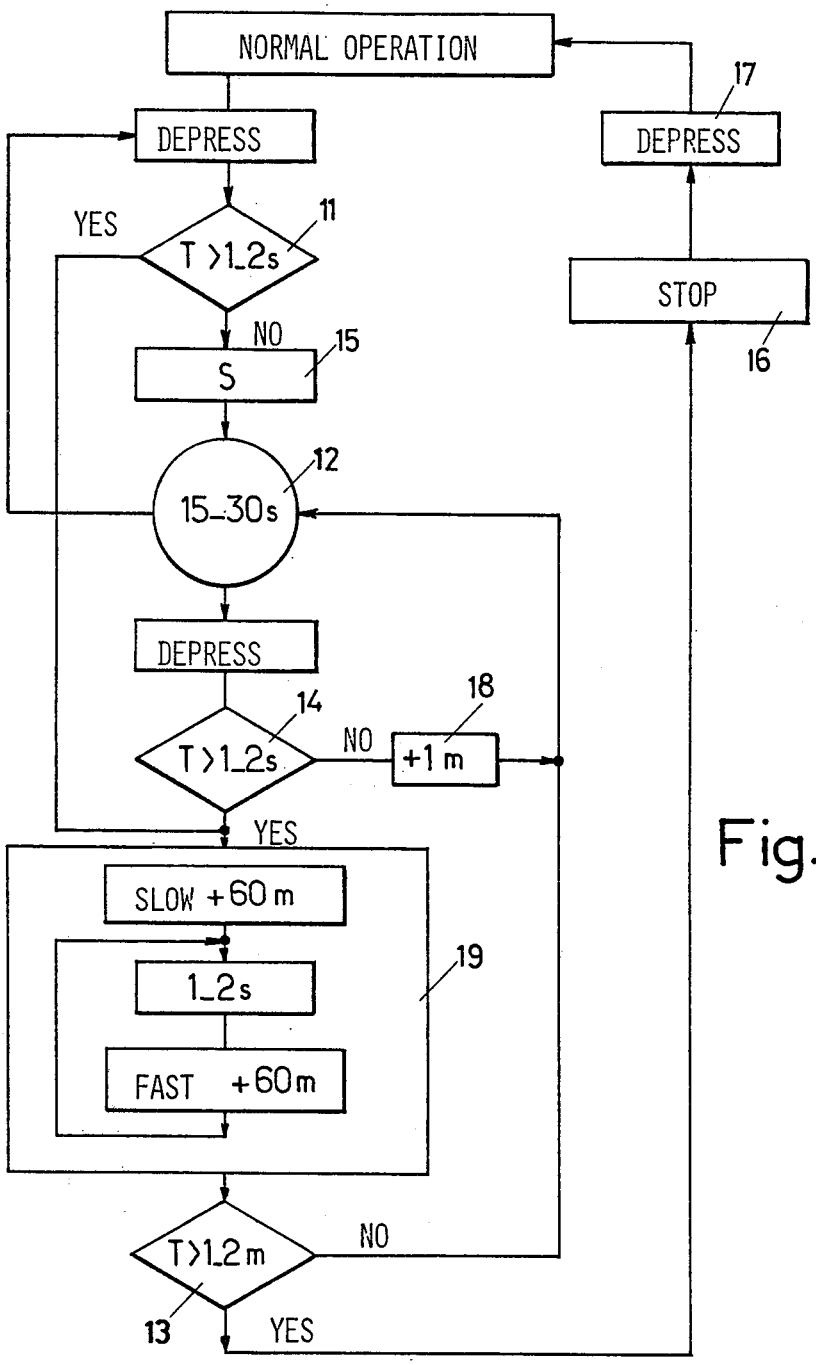
FIG. 1 is a flow chart of the correction control operations.

The device described is provided for incorporation in an analog display watch, comprising a minute hand which rotates around the watch dial in 60 minutes in normal operation, an hour hand which goes around the dial in twelve hours, and possibly a second hand which goes around the dial in one minute. However, the second hand may be moved independently while the hour and minute hands are always driven in a snychronized mode. When making corrections in respect of the time displays, the signal S in FIG. 2 causes the second hand to return to the axis of the watch, at 0 second, and the signal M causes the hour indicated by the hour and minute hands to advance, by means of pulses, each of which produces an advance movement of a step equivalent to one minute. For the sake of clarity of the description, the dial is assumed as being divided into 60 graduations, whether individually marked or not, corresponding to 60 steps of a minute.

The entire correction operation is controlled as from normal operation of the watch (FIG. 1) by means of a single control button, manual pressure on which results in a continuous signal SW. The signal is transmitted in parallel to four circuits, three of which comprise time comparison counters 21, 22 and 23 (see FIG. 2) which make it possible, inter alia, to divide the depressions, and consequently to select the correction modes. In the whole of the diagrams in FIG. 2 and FIG. 3, the usual symbolism is used in respect of logic gates.

By means of the comparison counter 31 (see FIG. 2), a first circuit makes it possible to determine whether the time T for which the depression lasts, and therefore the corresponding logic state in the signal SW (in this case, state 1), is or is not at least between one to two seconds, and thus to distinguish a short pressure (less than 1 to 2s) from a long pressure (more than 1 to 2s). This operation is achieved in blocks 11 and 14 in FIG. 1. The counter 21 may comprise, for example, an assembly of two cascaded flip-flops, the output of which is fed back to the input, which forms a divider which is reset to zero by the signal SW, counting the pulses of a signal, at a frequency of 1 Hz, which is admitted with the signal SW by way of a NOR-gate 24 which transmits a pulse at logic level 1 when the three signals at the input of which SW and the feedback signal are inverted, are at level 0. The signal produced at the output of the counter 21 is applied to an input of a NAND-gate 35 which is cross-coupled to another NAND-gate 36 so as to form a latch. Then, after the transmission of two pulses of the 1 Hz signal during the presence of the signal SW, pulses of the 1 Hz signal during the presence of the signal SW, it controls, by way of state 0, a NOR-gate 25 whose other input receives the inverted signal SW. The signal H at the output of this gate is therefore a continuous signal at level 1 as long as the pressure lasts, after 1 to 2 seconds. The latter signal is transmitted to a circuit 26 to be used in the hours correction mode.

Another circuit employs a comparison counter 22 to determine whether the time T for which the depression lasts is or is not at least between one and two minutes. The counter 22 may comprise, for example, a flip-flop to which are applied the inverted signal SW and a clock signal MN at the frequency of one pulse per minute, and which is followed by an AND-gate 27 which ANDs the signal MN with the inverted output signal of the flip-flop, so that it produces the pulse on the second MN pulse after commencement of the signal SW. This pulse is then transmitted to a STOP circuit 28 which causes the display means to stop, when the signal SW ends at the end of a depression. This control is synchronized to the pulses of the signal at a frequency of 1 Hz. This arrangement is particularly useful in the case of an electronic watch having an electro-optical display which simulates the hands of an analog display, for in that case the time counting operation continues but the hands are no longer made visible and the display means no longer consumes electrical power.

Figure 2:
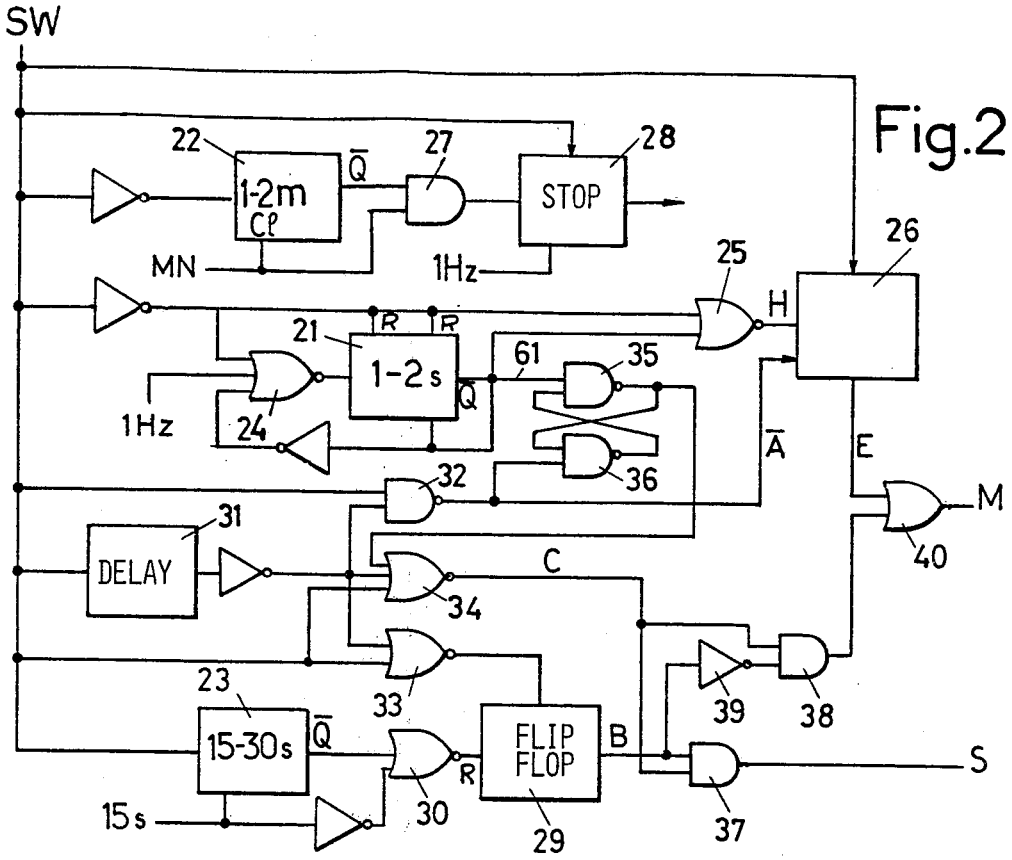
FIG. 2 is a block diagram of the electronic circuits of one illustrative device embodying the invention.

The stop circuit 28 has not been shown in detail in FIG. 2, since those skilled in the art will appreciate that it can be formed by combinations of logic gates, in accordance with its allotted functions. In the particular case considered herein, FIG. 1 shows that, after evaluation of the duration of the depression at 13 and stopping of the display means at 16, the normal display is resumed, this being achieved at 17 by a fresh depression of the control button. Thus, the control action which provides for re-setting the normal display in operation is effected in the circuit 28 (FIG. 2), upon the occurrence of a fresh state 1 in the signal SW.

The purpose of the third comparison counter 23 is to distinguish the successive correction sequences from each other, for which purpose, in the particular case described herein by way of example, a minimum time of from 15 to 30 seconds without a depression is required. The counter 23 may be of the same construction as the previous counter 22, except that the inputs of the flip-flop receive on the one hand the non-inverted signal SW and on the other hand a pulse every fifteen seconds (signal 15s in FIG. 2), for re-setting to zero, and except that the AND-gate is replaced by a NOR-gate 30, the 15s signal to this gate being inverted. Therefore, after the depression is terminated, the gate 30 produces a pulse of level 1 which signals a waiting period of more than fifteen to thirty seconds. This pulse is transmitted to the zero resetting input of a flip-flop 29, the purpose of which is to distinguish the first short pressure from the following ones, in each correction sequence.

The fourth circuit to which the signal SW is transmitted processes the signal to produce three different signals on detecting the rising and falling edges of the signal SW. The SW is delayed by a circuit 31 for a very short period in relation to the comparison time, of the order of a millisecond. The slightly delayed and inverted signal is transmitted in parallel to three gates 32, 33 and 34 which each also receive the initial signal SW on another input.

The first gate 32 is a NAND-gate which produces a signal A which marks the positive edge of the signal SW, by the logic level 0. The signal A is transmitted to the circuit 26 for controlling correction operations in the hours correction mode. It is also used for causing switching of the latch formed by the gates 35 and 36.

The second gate 33 is a NOR-gate which marks the negative edge of the signal SW, that is to say, the end of a depression, by a pulse at logic level 1. This signal is transmitted to the flip-flop 29 which, since it is re-set to zero by the output of the counter 23, distinguishes the first depression following the waiting time of fifteen-thirty seconds from subsequent depressions. The diagram shown in FIG. 2 assumes that, in the case described herein, the signal B at the output of the flip-flop 29 goes to logic level 1 at the first depression (at the end of the depression), and to logic level 9 at the second depression.

Thirdly, the NOR-gate 34 comprises an additional input for the output signal from the latch formed by the gates 35 and 36. This signal is taken off at the output of the gate 35. It is only when it is at logic level 0 that the falling edge of the signal SW (end of depression) results in a pulse at level 1 in the output signal C of the gate 34. Now, this occurs when, after the signal A is received at the gate 36, the signal 61 in state 1 has in the meantime caused switching of the latch, before the end of the depression, that is to say, when this is a short depression.

This pulse signal which is characteristic of the short depressions is transmitted either by one or the other of two AND-gates 37 and 38, depending on the state of the signal B at the output of the flip-flop 29. Upon the first short depression of a correction sequence, the signal B at level 1 opens the gate 37 which then, by means of its output signal S, causes the second hand to return to the axis of origin of the watch dial, at 00 second. This operation is indicated at 15 in FIG. 1. In the event of following short depressions in the same correction sequence, the signal B at level 0, which however is inverted by an inverter 39 (see FIG. 2), in contrast opens the gate 38 which then produces a correction pulse to one of the inputs of an OR-gate 40 whose output signal M causes the minute hand to advance by a step on the minutes graduations (at 18 in FIG. 1). FIG. 2 also shows that the forward movement of one step may also be controlled by a signal E which is derived from the circuit 26 and admitted to another input of the OR-gate 40.

Figure 3:
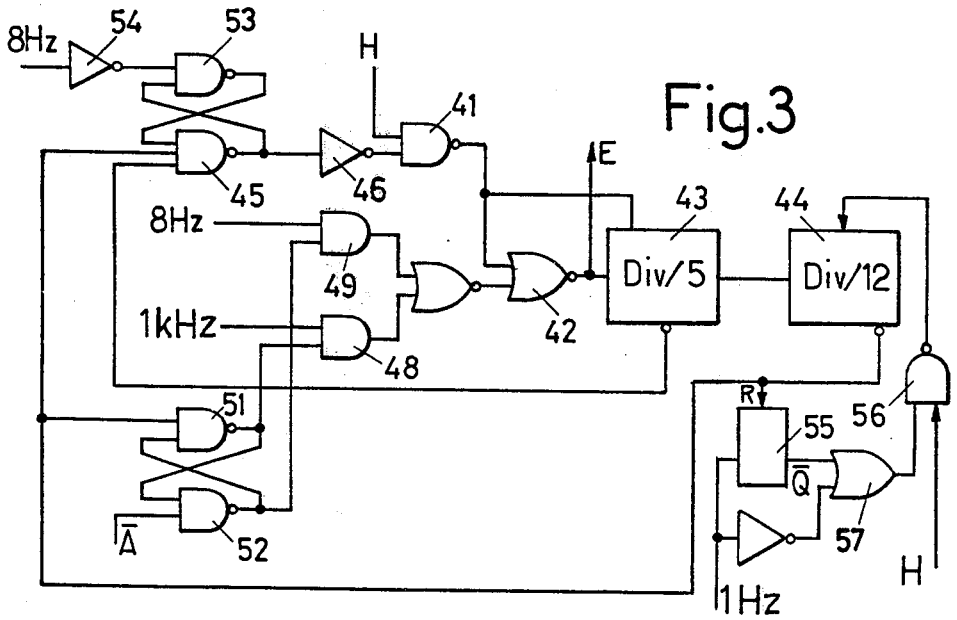
FIG. 3 is a detailed diagram of a part of the circuits shown in FIG. 2.

The illustrative circuits used in the hours correction mode are shown in detail in FIG. 3. The signal H which, it will be recalled, indicates at logic level 1 selection of the hours correction mode by virtue of a depression lasting for more than one to two seconds, controls a NAND-gate 41 and then a NOR-gate 42, upon the input of pulses into a counter formed by two series frequency dividers, a divider 43 which divides by five and a divider 44 which divides by twelve.

The divider 43 is set to zero by the output signal of the gate 41, the pulses of which indicate, with the signal H being present at one of its inputs, the end of the operation of counting sixty pulses by virtue of a signal transmitted to the other input, originating from the divider 44, by a circuit comprising a gate 45 and an inverter 46.

The pulses applied to the counter also serve to advance the minute hand by one step (on graduation of a minute) for each pulse. For this purpose, the signal E at the output of the gate 42 is transmitted to one of the inputs of the OR-gate 40 (FIG. 2). These correction pulses are emitted at rates which are determined by the other components of the circuit shown in FIG. 3, from signals at frequencies of 1 Hz, 8 Hz and 1 kHz.

The signals at 1 kHz and 8 Hz are applied to respective AND-gates 48 and 49 between which selection is effected by two cross-coupled NAND-gates 51 and 52 forming a latch. The output signal of the divider 44 which divides twelve, which signal contains a negative pulse at the end of the operation of counting the sixty correction pulses, is applied to the other input of the gate 51 while the signal A from the processing circuit and more precisely from the gate 32, which, by a pulse at logic state 0, marks the commencement of each control depression, is applied to the other input of the gate 52. The transmitted pulse of the signal A, which pulse is inverted by the gate 52, opens the AND-gate 49 to transmit the pulses at a lower frequency of 8 Hz, but, after sixty of such pulses, the output signal of the counter (of the divider 44) causes switching of the memory at the same time as it opens the gate 48 for the following counting cycles which are therefore effected on pulses at the higher frequency of 1 kHz. These operations are indicated in block 19 of the diagram of FIG. 1 by two different speeds, being a slow speed and a fast speed respectively, at which the display means advances in cycles of 60 steps.

However, the 1 kHz pulses are admitted only in trains of five pulses, the trains recurring at the frequency of 8 Hz.

For this purpose, another latch is formed by the above-mentioned gate 45 and another NAND-gate 53 cross-coupled therewith. The signal at a frequency of 8 Hz is transmitted by an inverter 54 to another input of the gate 53. The output signal for the gate 41 is taken off at the output of the gate 45, as already noted above. When the correction pulses are at a frequency of 8 Hz, the latch has no effect. It remains in state 0, except for transmitting the pulses for zero re-setting of the counter, which are contained in the inverted output signal of the divider 44. However, when the counting operation is performed on the pulses of the signal at a frequency of 1 kHz, the inverted output signal of the divider 43 switches the latch to state 1 until the following pulse of the signal at a frequency of 8 Hz. The transmission of the correction pulses, during that period of time, is therefore interrupted at the gate 42 at the same time as the divider 43 is set to zero. Hence, trains of 5 pulses follow each other at a frequency of 8 Hz, until sixty steps have been counted.

Irrespective of the state of the latch 51–52 effecting selection between the two speeds, the divider 44 is reset to zero by way of a circuit which introduces a buffer delay of one to two seconds, during which the output signal of the divider 44 stops the correction pulses at the gate 42 (to which it is transmitted by the gates 45 and 41). This circuit comprises a flip-flop 55 which at its zero re-setting input receives the inverted output signal of the divider 44 and which is switched by the pulses of a signal at a frequency of 1 Hz which, when inverted, is combined with the signal of the Q output of the flip-flop by an OR-gate 57. It is therefore only the second 1 Hz pulse after the end of a cycle of counting in sixty steps, which re-sets the divider 44, being transmitted thereto by a NAND-gate 56 which stops it if the signal H is no longer present on its other input.

It will be understood therefore that in the hours correction mode, cessation of the depression, which returns the signal H to logic state 0, causes termination of the correction operation, but only after the end of the counting cycle being performed. It is in this way that the correction opreation is effected in complete hours (sixty steps). If then depression of the control button is repeated without allowing the waiting period of fifteen to thirty seconds to elapse between correction sequences, the signal B is not changed and we go back to 14 in FIG. 1, in order to resume correction in respect of minutes in a stepwise manner when a short depression is effected or to return to the hours correction mode if the depression is long, but in that case remaining the slow speed.

Hereinbefore, the mode of operation of the device has been described at the same time as the configuration of the circuits. It will be sufficient now briefly to recall how a complete correction sequence is performed. The device automatically imposes the succession of seconds, minutes and hours, in that order. Short depressions are used to begin. The first depression returns the second hand to 00, and the following depressions cause the display to advance by a step of one minute at the end of each depression by the signal C. A long depression then results in the hours correction mode coming into effect, for a first complete turn of the minute hand around the signal at slow speed (step at a frequency of 8 Hz), and the following at fast speed (twelve trains of five pulses), as long as the pressure is maintained. Each turn around the dial, once begun, is always finished and a pause period of one to two seconds is marked at the end of each turn of the hand. After the pressure is removed, if the waiting period before a new depression is at least 15–30 seconds, it is a new sequence which begins again, possibly with correction of the seconds and minutes in a stepwise manner in the case of short depression. If, in contrast, a long depression lasts for more than one to two minutes this causes the display to stop.

While there is shown and described, one preferred illustrative embodiment of the invention, it will be understood by those skilled in the art that other modifications may be made withint the principles of the invention and the scope of the appended claims.

What is claimed is:

1. A device for controlling correction operations of a time display device showing hours and minutes comprising a control button and means for distinguishing a short depression from a long depression, depending on the period of actuation of the control button, means for selecting in the case of a short depression a minutes correction mode in which the display advances by one minute for each depression and, in the case of a long depression, an hours correction mode in which the display advances by complete hours as long as the depressions last, and means for defining two different advance speeds, a slower speed and a faster speed, in the hours correction mode, and means for passing automatically firstly to the slow speed to advance a first hour and then to the fast speed for the following hours.

2. A device according to claim 1 wherein the display device also displays seconds, further comprising means for distinguishing a first short depression from following short or long depressions, and means for automatically returning the seconds display to 0 upon the first short depression.

3. A device according to claim 1 or 2 wherein the display device is an electro-optical display which simulates the hands of an analog display, further comprising means for causing said hands to be no longer visible when the duration of a long depression exceeds a predetermined period.

* * * * *